US011103017B2

(12) United States Patent
Samaniego et al.

(10) Patent No.: US 11,103,017 B2
(45) Date of Patent: Aug. 31, 2021

(54) PROTECTIVE GARMENT WITH HARNESS ACCESS

(71) Applicant: DUPONT SAFETY & CONSTRUCTION, INC., Wilmington, DE (US)

(72) Inventors: Muriel Samaniego, Oberkochen (DE); Alain Weimerskirch, Contern (LU)

(73) Assignee: DUPONT SAFETY & CONSTRUCTION, INC., Wilmington, DE (US)

( * ) Notice: Subject to any disclaimer, the term of this patent is extended or adjusted under 35 U.S.C. 154(b) by 315 days.

(21) Appl. No.: 16/116,371

(22) Filed: Aug. 29, 2018

(65) Prior Publication Data

US 2019/0069610 A1 Mar. 7, 2019

Related U.S. Application Data

(60) Provisional application No. 62/553,327, filed on Sep. 1, 2017.

(51) Int. Cl.

| | |
|---|---|
| ***A41D 13/00*** | (2006.01) |
| ***A41D 13/02*** | (2006.01) |
| ***A62B 17/00*** | (2006.01) |
| ***A62B 35/00*** | (2006.01) |

(52) U.S. Cl.

CPC ..... *A41D 13/0002* (2013.01); *A41D 13/0007* (2013.01); *A41D 13/02* (2013.01); *A62B 17/006* (2013.01); *A62B 35/0037* (2013.01); *A41D 2200/20* (2013.01); *A41D 2300/33* (2013.01)

(58) Field of Classification Search

CPC ... A41D 13/0002; A41D 13/02; A62B 17/006

See application file for complete search history.

(56) References Cited

U.S. PATENT DOCUMENTS

| | | | | | |
|---|---|---|---|---|---|
| 1,849,628 | A * | 3/1932 | Lemercier | B64D 17/30 | 244/143 |
| 2,311,899 | A * | 2/1943 | Marlowe | A61H 33/063 | 4/536 |
| 2,728,916 | A * | 1/1956 | Clarke | A41D 13/02 | 2/82 |
| 3,230,546 | A * | 1/1966 | Sabee | A41D 13/1209 | 2/114 |
| 3,307,554 | A * | 3/1967 | Thornton | A41D 13/0051 | 607/107 |
| 3,475,767 | A * | 11/1969 | Friesen | A61G 9/006 | 4/452 |

(Continued)

*Primary Examiner* — Richale L Quinn

(57) ABSTRACT

A protective garment having a support harness conduit comprising a flexible transition duct and a flexible rope cover forming a sleeve vertically centered on the back of the garment, the transition duct being attached to both arm sections and the torso section of the garment, or attached to the back below the neck section extending to above the waist of the garment, the torso end of the transition duct having a width wider than the back of the garment; with the distal closure end of the rope cover having a closure device to close the conduit and reduce the interchange of fluids or particulates between the interior and the exterior of the garment; wherein the rope cover end of the transition duct has a width that is at least 30 percent the width of the back of the garment.

22 Claims, 9 Drawing Sheets

(56) References Cited

U.S. PATENT DOCUMENTS 4,017,926 A * 4/1977 Piel ..... B63C 9/1055 441/104
4,214,321 A 7/1980 Nuwayser
4,230,114 A * 10/1980 Feather ..... A61F 5/34 2/227
4,272,851 A * 6/1981 Goldstein ..... A41D 27/24 2/275
4,753,182 A * 6/1988 Blackburn ..... A41D 27/24 112/419
4,772,510 A 9/1988 McClure
4,833,010 A 5/1989 Langley
4,847,914 A * 7/1989 Suda ..... A62B 17/006 2/457
4,855,178 A 8/1989 Langley
4,876,746 A * 10/1989 Howie ..... A41D 13/0025 2/69
4,920,575 A 5/1990 Bartasis et al.
5,035,941 A 7/1991 Blackburn
5,040,902 A * 8/1991 Eaton ..... B65F 1/0006 383/7
5,062,424 A * 11/1991 Hooker ..... A61F 7/0053 128/897
5,162,148 A 11/1992 Boyé et al.
5,548,842 A * 8/1996 Wiseman, Sr. .... A41D 13/0002 128/201.29
5,626,947 A 5/1997 Hauer et al.
6,305,024 B1 * 10/2001 Schweer ..... A41D 13/0007 182/3
6,892,395 B2 * 5/2005 Schweer ..... A41D 13/0007 182/3
6,948,191 B2 * 9/2005 Avery ..... A62B 17/006 2/456
7,356,850 B2 * 4/2008 Turcotte ..... A41D 13/0007 182/3
7,571,494 B2 * 8/2009 Grilliot ..... A62B 35/0037 182/3
7,596,815 B2 * 10/2009 Grilliot ..... A41D 13/0007 2/227
7,707,660 B2 * 5/2010 Grilliot ..... A62B 35/0025 2/455
7,971,273 B2 * 7/2011 Grilliot ..... A41D 13/0007 2/81
8,375,467 B2 * 2/2013 Real ..... A41D 13/0007 2/69
8,776,266 B1 * 7/2014 Metz ..... A41D 13/0007 2/94
9,241,515 B2 * 1/2016 Kim ..... A45F 5/02
9,566,408 B2 * 2/2017 Henry ..... A61M 16/142
9,956,112 B2 * 5/2018 van Oudenallen ..... A61F 7/02
10,016,002 B2 * 7/2018 Murphy ..... A62B 35/0025
10,188,476 B1 * 1/2019 Jain ..... A41D 13/1236
10,343,001 B2 * 7/2019 Seman ..... A62B 35/0043
10,463,086 B2 * 11/2019 Brown ..... A41D 11/00
10,485,274 B2 * 11/2019 Allen ..... A41D 13/0007
2005/0017566 A1 * 1/2005 Rizk ..... A47D 15/006 297/465
2005/0178138 A1 * 8/2005 Blackstone ..... A41D 13/0025 62/259.3
2007/0028344 A1 * 2/2007 Czajka ..... G09F 3/00 2/51
2008/0000006 A1 * 1/2008 Ochoa ..... A41D 13/1236 2/114
2009/0064392 A1 * 3/2009 Rachuba, IV ..... A41D 19/01 2/158
2009/0165186 A1 * 7/2009 Mijares ..... A41D 13/1236 2/83
2010/0179624 A1 * 7/2010 Anderson ..... A61F 7/02 607/104
2012/0047622 A1 * 3/2012 van Oudenallen ..... A41D 13/0051 2/81
2013/0231723 A1 * 9/2013 Van Oudenallen ... A61F 7/0085 607/107
2015/0335470 A1 * 11/2015 Panser ..... A41D 13/0051 607/107
2018/0084843 A1 * 3/2018 Nicholai ..... A45F 4/08
2018/0103693 A1 * 4/2018 Reagan ..... A41D 15/002
2018/0140033 A1 * 5/2018 Thornton ..... A42B 1/22
2019/0166930 A1 * 6/2019 Stewart ..... A41D 13/129

* cited by examiner

PROTECTIVE GARMENT WITH HARNESS ACCESS

BACKGROUND OF THE INVENTION

Field of the Invention

This invention relates to a protective garment for a worker that can be worn over a safety harness, without the protective garment increasing the risk of injury to the worker in a fall. Preferably the garment maintains a degree of sealing between the interior and exterior of the suit.

Description of Prior Art

U.S. Pat. No. 5,548,842 to Wiseman discloses a protective garment with a support harness conduit for safety harness access while maintaining reduced fluid flow between the interior and the exterior of the garment.

Protective garments that can be worn by a worker in conjunction with the use of a safety harness are disclosed in Wiseman. However, garment design has concentrated on adequate sealing of the suit; that is, on providing a garment capable of being used with a safety harness worn underneath the suit by the worker, while providing some degree of sealing around the safety rope that passes through the protective garment.

However, some have suggested that in addition to environmental threats, there can be other potential threats to a worker working from heights with such a combination of safety harness and protective garment. One consideration is the reduction of the potential for injury from the combination of suit and harness to a worker during or after a fall by improved garment design. A fallen worker, while hanging from the safety rope and waiting to be rescued, could potentially experience significant additional tension under the arms or in the upper body area, or worse. Therefore any improvement in garment design that significantly reduces or eliminates potential work injuries is desirable.

BRIEF SUMMARY OF THE INVENTION

This invention relates to a protective garment having an interior surface and an exterior surface, and a front for covering the front of the body and a back for covering the back of the body, the protective garment comprising two arm sections, a neck section, a torso section, and a support harness conduit; the support harness conduit comprising:

a flexible transition duct and a flexible rope cover, the flexible transition duct and the flexible rope cover forming a sleeve vertically centered on the back of the garment in the torso section, the transition duct having a torso end and a rope cover end, the flexible rope cover having a proximate end attached to the transition duct rope cover end, and a distal end;

the torso end of the transition duct being attached to both arm sections and the torso section, the torso end thereby having a width wider than the back of the garment, extending across the back of the garment from one arm section to the other;

the torso end of the transition duct providing an opening in the torso section between the arm sections and below the neck section, with the rope cover end of the transition duct providing an opening in the transition duct for the proximate end of the rope cover;

the distal closure end of the rope cover having a closure device to close the conduit and reduce the interchange of fluids or particulates between the interior and the exterior of the garment;

wherein the rope cover end of the transition duct has a width that is at least 30 percent the width of the back of the garment.

In some other embodiments, this invention relates to a protective garment having an interior surface and an exterior surface, and a front for covering a front of the body and a back for covering a back of the body, the protective garment comprising two arm sections, a neck section, a torso section, and a support harness conduit; the support harness conduit comprising:

a flexible transition duct and a flexible rope cover, the flexible transition duct and the flexible rope cover forming a sleeve vertically centered on the back of the garment in the torso section, the transition duct having a torso end and a rope cover end, the flexible rope cover having a proximate end attached to the transition duct rope cover end, and a distal end;

the torso end of the transition duct being attached to the back below the neck section extending vertically to above the waist of the garment, the torso end having a vertical length wider than the back of the garment;

the torso end of the transition duct providing an opening in the torso section between the arm sections and below the neck section, with the rope cover end of the transition duct providing an opening in the transition duct for the proximate end of the rope cover;

the distal closure end of the rope cover having a closure device to close the conduit and reduce the interchange of fluids or particulates between the interior and the exterior of the garment;

wherein the rope cover end of the transition duct has a width that is at least 30 percent the width of the back of the garment.

In one embodiment, the garment is a coverall having an attached hood, which is optionally provided with attached foot coverings.

In another embodiment, the protective garment is further provided with a fastener for attaching the support harness conduit to the garment when not in use.

DETAILED DESCRIPTION OF THE INVENTION

Figure 1:
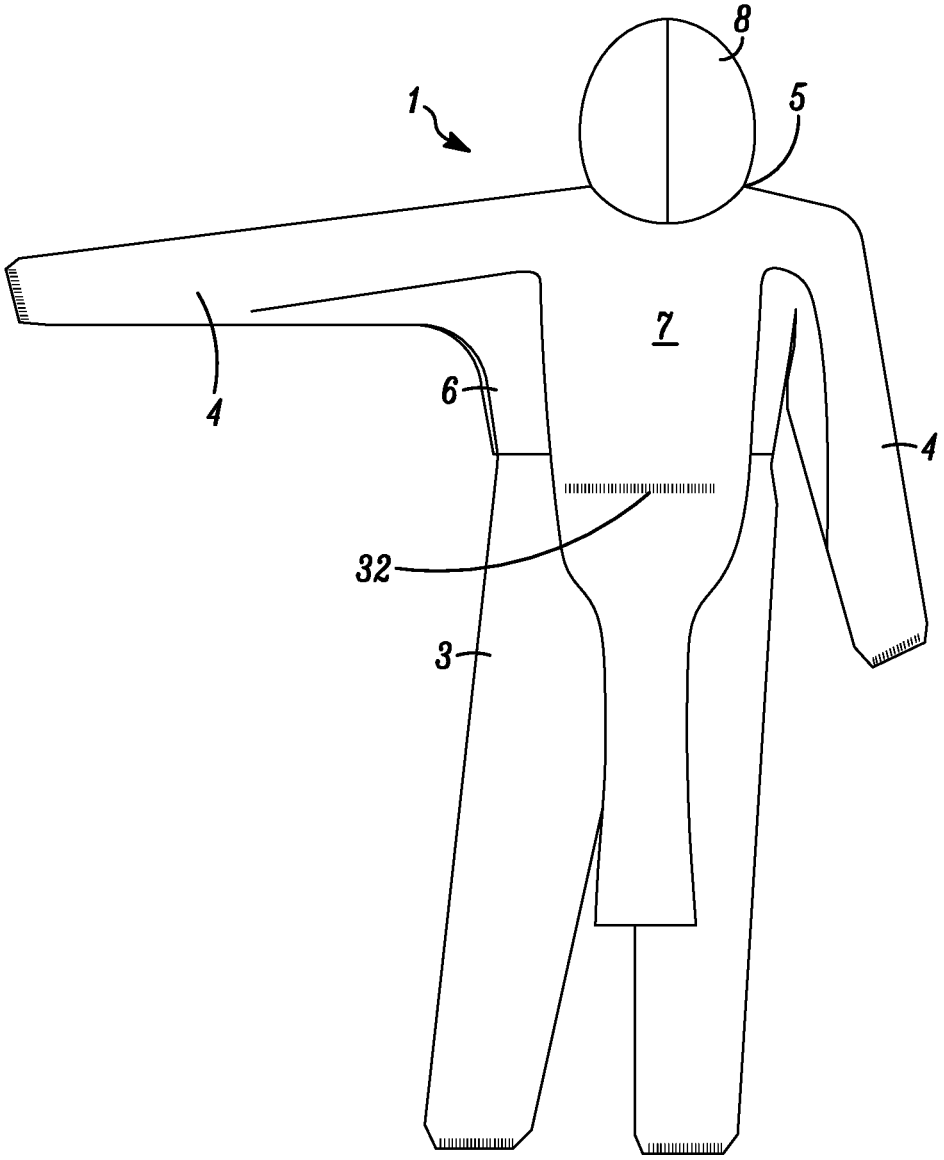
FIGS. 1 & 2 are general illustrations of the garment back and front, respectively, provided with the support harness conduit.

This invention relates to a protective garment that not only allows the use of a safety harness worn underneath the suit by the worker, but the protective garment also has features that help ensure the garment itself does not increase the risk of injuries to the wearer in the case of a fall. The protective garment has an interior and an exterior, and a front for covering the front of the body and a back for covering the back of the body. The protective garment comprises two arm sections, a neck section, a torso section, and a support harness conduit. The support harness conduit comprises a flexible transition duct and a flexible rope cover that can include a closure device. These features can be explained, without limitation, by referring to the drawings.

Figure 2:
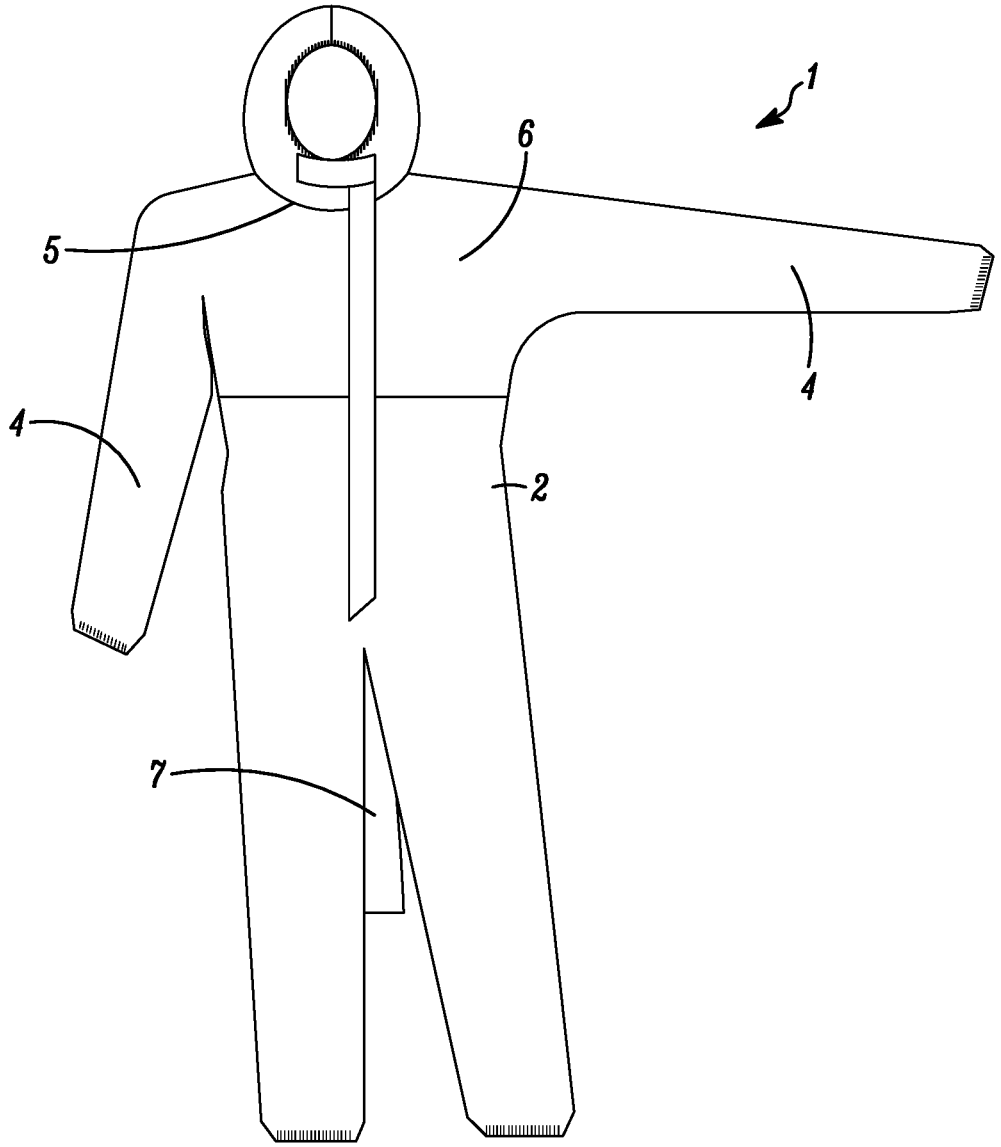

Specifically, FIG. 1 is a general illustration of the back 3 of one possible protective garment 1, and FIG. 2 is a general illustration of the front 2 of the same garment 1. The garment has an interior and an exterior, and comprises a protective fabric as the exterior surface of the garment. In some embodiments, the garment can have a fabric liner on the interior of the garment.

Figure 3:
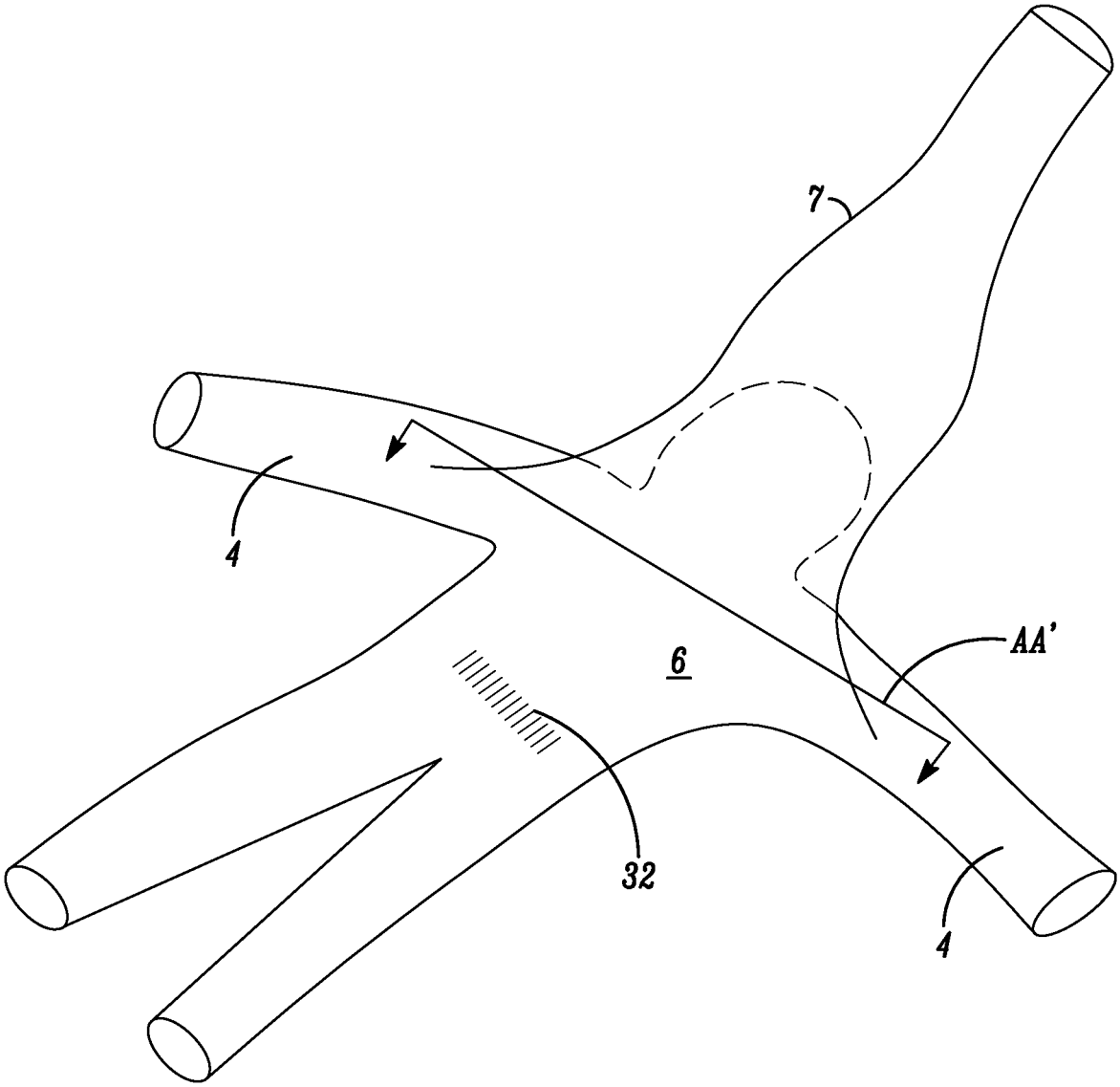
FIG. 3 is a perspective view of the garment with the support harness conduit raised to show the location of detail AA'.

The garment includes a torso section 6 for covering at least a portion of a person's torso and a neck section 5 for covering a person's neck. In some embodiments, as in FIG. 1, the garment can include an attached hood 8 to the neck section. The protective garment further comprises two arm sections 4 and a support harness conduit 7. As shown in FIG. 1, underneath the support harness conduit, the back of the garment can further comprise a gather 32 at the waist. FIG. 3 is a perspective view of the back of the garment with the support harness conduit 7 extended away from the garment to better illustrate this feature, and gather 32 at the waist. As shown in FIG. 3, the support harness conduit 7 essentially forms an additional sleeve in the garment for the harness safety rope and is vertically centered on the back of the garment in the torso section.

The torso section further comprises a plurality of openings, including at least openings for the head and neck, openings ending in arm sections for receiving a person's arms when the person wears the garment, and an opening for the support harness conduit for passage of a safety rope from the support harness worn by the wearer to the exterior of the garment. Each of the ends of the arm sections can have openings for a person's wrists and hands. If desired, the sleeves can be provided with sleeve closure features for closing the sleeves around the wrists of the wearer (not shown). String ties or tapes, hook and loop fasteners, elastic material, or other closure options can be employed as sleeve closure features if desired.

The garment 1 has an interior surface defined as the surface facing a person's body when the person wears the garment; that is, any surface of the garment that is closest to the wearer when the garment is worn, generally considered the inner surface of the garment. The exterior surface of the garment is defined as the surface facing a potentially hazardous environment or threat; that is generally considered the outer surface of the garment.

The support harness conduit comprises a flexible transition duct and a flexible rope cover, the flexible transition duct and the flexible rope forming a sleeve vertically centered on the back of the garment in the torso section. In some embodiments, the center of this vertically-centered sleeve is horizontally positioned from the neckline a distance of about 15 and 30 percent of the total linear distance between the neckline to the waistline of the garment.

Figure 4:
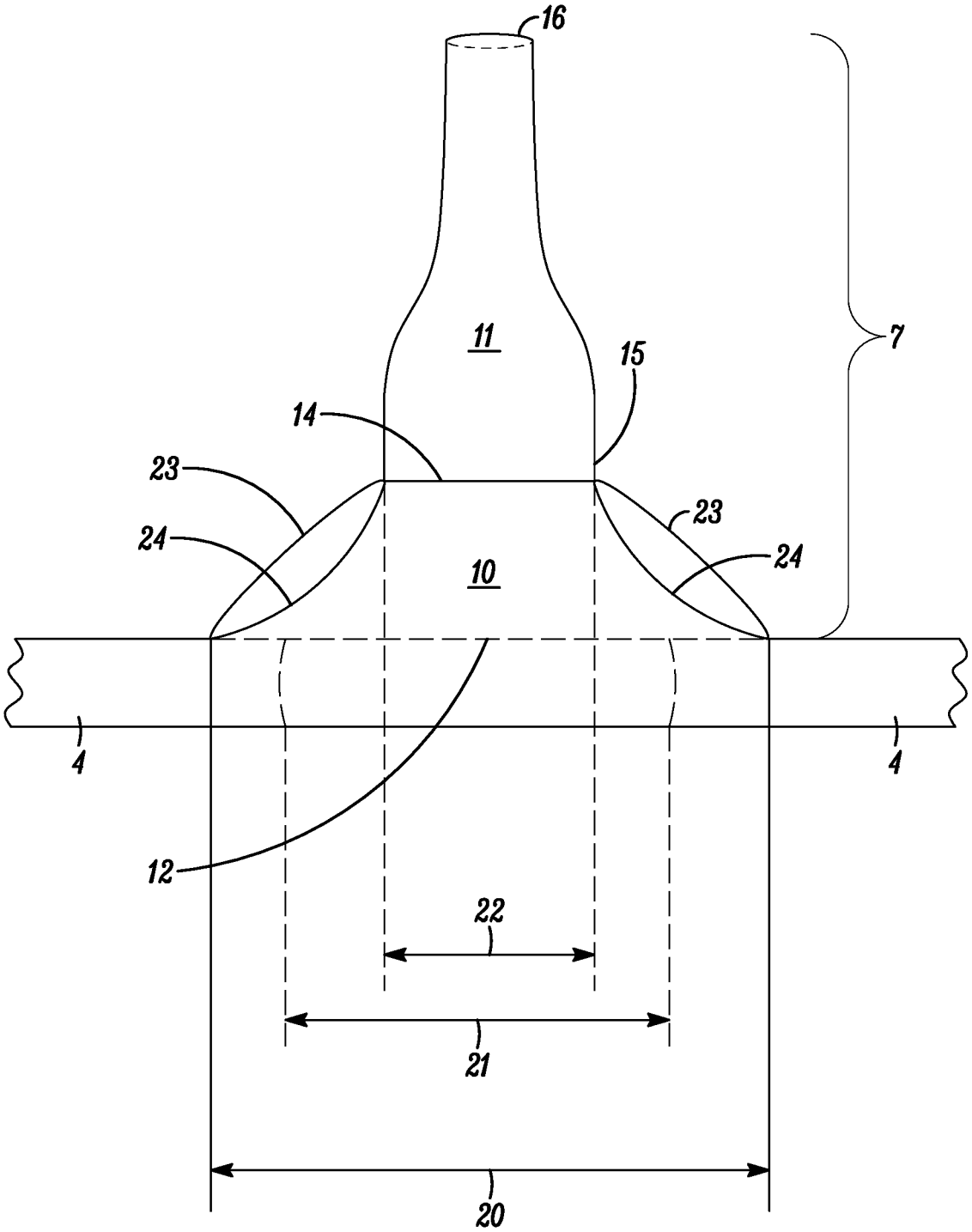
FIG. 4 is an illustration of detail AA', showing the attachment of the a flexible transition duct and a flexible rope cover to the back of the garment and arms, along with width dimensions.

FIG. 4 is an illustration of section AA' from FIG. 3 illustrating some of the features of the support harness conduit 7. As shown in FIG. 4, the support harness conduit includes a flexible transition duct 10 and a flexible rope cover 11. The transition duct further has a torso end 12 and a rope cover end 14. The flexible rope cover has a proximate end 15 attached to the transition duct rope cover end, and a distal end 16 that can be provided with a closure device (not shown).

As shown in FIG. 4, in this embodiment, the torso end 12 of the transition duct is attached to both arm sections 4 in addition to the torso section. The torso end 12 thereby has a width 20 wider than the width 21 of back of the garment, the torso end extending across the back of the garment from one arm section to the other.

The width of the torso end and the back of the garment can be measured by laying the garment flat on a table and measuring the linear distance. The width of the back of the garment 21 is the linear horizontal distance from edge to edge of the flat garment at chest level. When the garment is laid flat and the arm sections extended in opposing directions and flattened, due to the additional fabric provided by the torso end a fold occurs in the arm section. The initial point of contact of the torso end will be the beginning of this fold in the fabric in the arm section. Therefore, in this embodiment, the width 20 of the torso end 12 is the linear horizontal distance from the initial point of contact of the torso end with one of the arm sections to the initial point of contact of the torso end at the other arm section, when the arms of the garment are horizontally laid out flat and extended from the garment in opposing directions. In some embodiments, the torso end is at least 115% wider than the width of back of the garment; and in some embodiments the torso end is at least 150% wider than the width of the back of the garment.

In the support harness conduit, the transition duct is a tubular or hollow duct for passage of the safety rope from the safety harness to the rope cover; the rope cover is also a tubular or hollow duct for passage of the safety rope to the exterior of the garment. The torso end of the transition duct provides an opening in the torso section between the arm sections and below the neck section; and the rope cover end of the transition duct provides an opening in the transition duct for the proximate end of the rope cover. Further, as shown in FIG. 4, the rope cover end of the transition duct has a width 22, when measured flat, that is at least 30 percent the width of the back of the garment. In some embodiments, the rope cover end of the transition duct has a width that is 80 percent of the width of the back of the garment.

In some embodiments, the transition duct is a tubular or hollow duct having a trapezoidal shape, the torso end being wider than the rope cover end. This trapezoidal shape can have an essentially straight sides 23 as shown in FIG. 4, or alternatively in a more preferred embodiment, this trapezoidal shape can have curved sides 24 as also shown in FIG. 4. (Both are shown in FIG. 4 for comparison.) Further, in some embodiments, the height of the trapezoidal shaped transition duct, measured perpendicularly from the torso end (in the plane of the back of the garment) to the rope cover end, is preferably 20 to 50 percent of the entire length of the support harness conduit 7.

In some preferred embodiments, the shape of the opening in the back of the garment formed by the torso end is preferably a simple straight slit extending from one arm section to the other arm section; or an elongated oval shape extending from one arm section to the other arm section.

In some other embodiments, the shape of the opening in the back of the garment formed by the torso end can be a simple straight slit vertically-oriented and centered on the back of the garment, or a vertically-oriented elongated oval shape centered on the back of the garment (not shown). In these embodiments, the opening vertically extends from below the neck section to above the waist of the garment. Also, in these embodiments, the torso end has a vertical length wider than the back of the garment. Further, in these vertically-oriented embodiments, the center of the torso end is horizontally positioned from the neckline a distance of about 20 to 65 percent of the total linear distance between the neckline to the waist of the garment.

Figure 5:
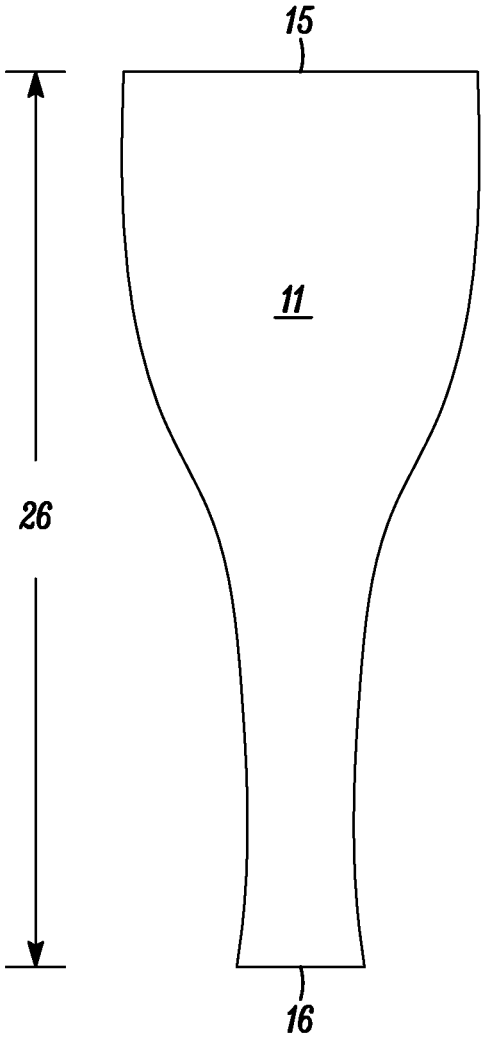
FIGS. 5 & 6 are illustrations of two possible rope cover shapes.
Figure 6:
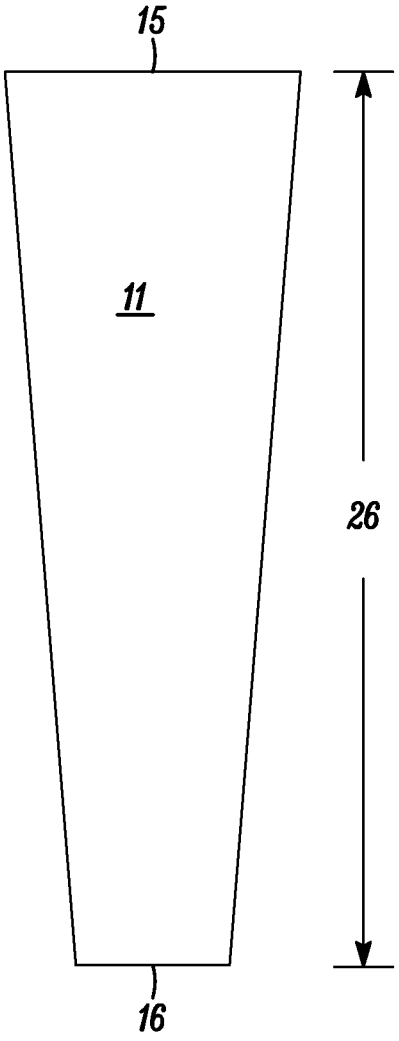

The rope cover is essentially a hollow sleeve or tube. FIGS. 5 & 6 are illustrations of two possible general rope cover shapes, the hollow sleeve or tube as seen laid flat on a table. The flexible rope cover has a proximate end 15 that is attached to the transition duct rope cover end, and a distal end 16 that has a closure device (not shown). While the distal end of the flexible rope cover only has to be wide enough to pass the end of the safety rope, from a practical standpoint, it is preferred the distal end is wide enough for a person's hand to reach inside the rope cover to grasp the safety rope.

The width of the proximate end of the rope cover, when measured flat, is the same as the width of the rope cover end of the transition duct; that is, it is at least 30 percent of the width of the back of the garment. In some embodiments, the width of the proximate end of the rope cover is at least 80 percent of the width of the back of the garment.

As shown in FIGS. 5 & 6, the rope cover has a length 26, again measured by laying the rope cover flat on a table and measuring the linear distance from the edge of the proximate end to the edge of the distal end. In some embodiments the rope cover length is at least 20 cm. In some embodiments the rope cover has a length that is at least 1 meter. As shown in the figures, the rope cover preferably has a cone shape with either straight or curved sides, with the cone shape having a curved side being preferred.

Figure 7:
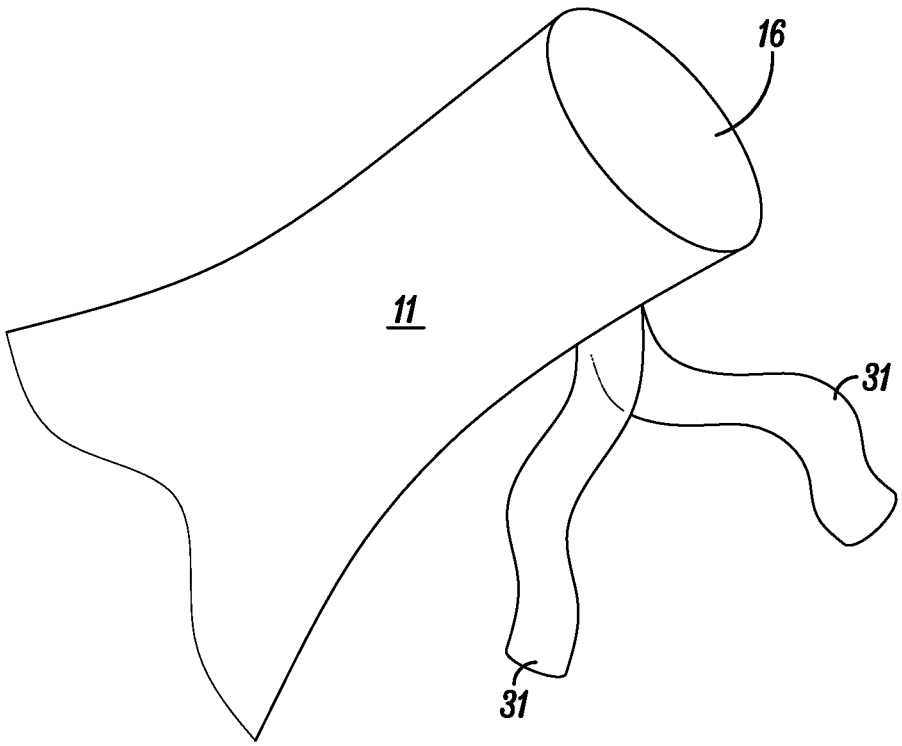
FIG. 7 is a detail of one representation of a rope cover closure device in the form of a nonwoven fabric tie.

The distal end 16 of the rope cover 11 has a closure device to compress the conduit around the safety rope and close the conduit to reduce interchange of fluids or particulates between the inside and the outside of the garment. FIG. 7 is a detail of one representation of a rope cover closure device in the form of a nonwoven fabric tie. As shown, the particular preferred embodiment is a tie having two straps 31 sewn to the rope cover. The two straps can then be wrapped around the rope cover, after the harness rope has been inserted, and used to snug the rope cover to the rope by simple tying of the two ends together.

If ties are used, they can be made from many different types of durable woven or nonwoven or webbing materials, as long as they have adequate strength in the use. For example, ties can be made from a fabric like DuPont Tychem® F fabrics, which feature a film-laminated Tyvek® fabric. One useful feature is to make the ties from a fabric having a different color from the protective garment fabric so that they can be readily recognized.

The protective garment can have even more features that can be desirable. For example, as shown in FIG. 3, the back of the garment can further comprise a gather 32 at the waist. This prevents the excess garment fabric above the waist from drooping down and potentially interfering with the use of the garment. Various types of gathers may be used. One particularly desirable gather is an elastic band sewn or glued under tension to the garment.

As shown in FIGS. 1 & 2, the protective garment can be a coverall, additionally having legs attached to the torso section and an attached hood 8.

Figure 8:
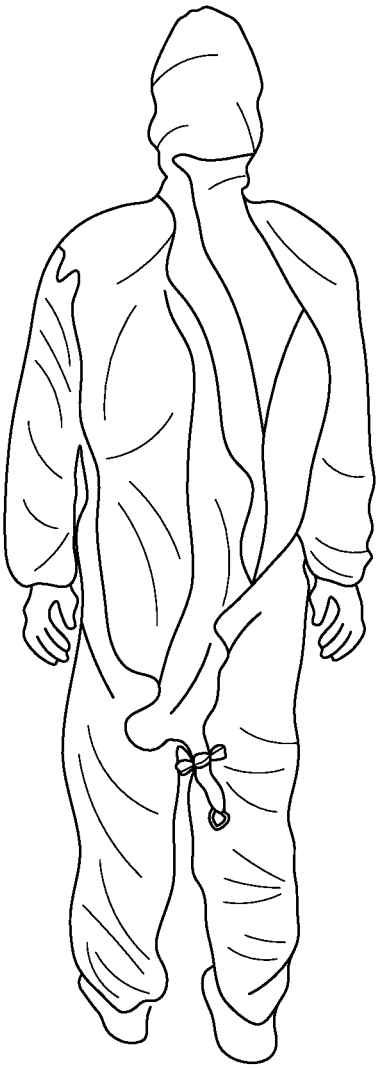
FIGS. 8 & 9 illustrate the back and side of a garment in the form of a coverall with a hood as worn with a safety harness, including the use of a nonwoven fabric tie to close the distal end of the rope cover to the safety harness rope.
Figure 9:
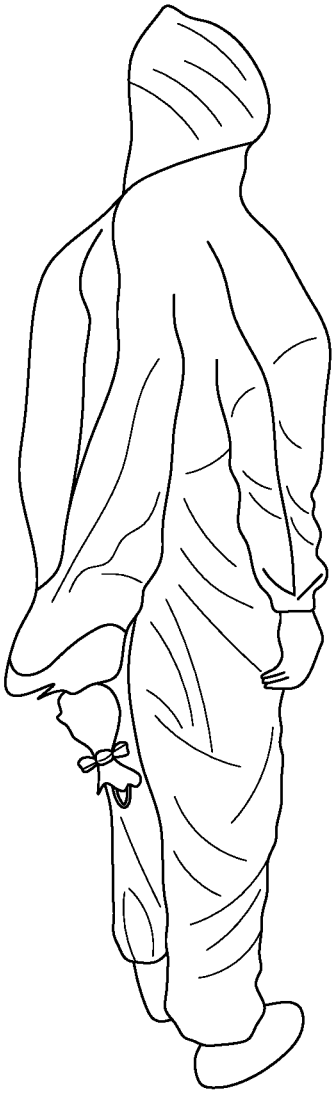

FIGS. 8 & 9 illustrate the back and side of a garment in the form of a coverall with a hood as worn over a safety harness, including the use of a nonwoven fabric ties to close the distal end of the rope cover to the safety harness rope.

Figure 10:
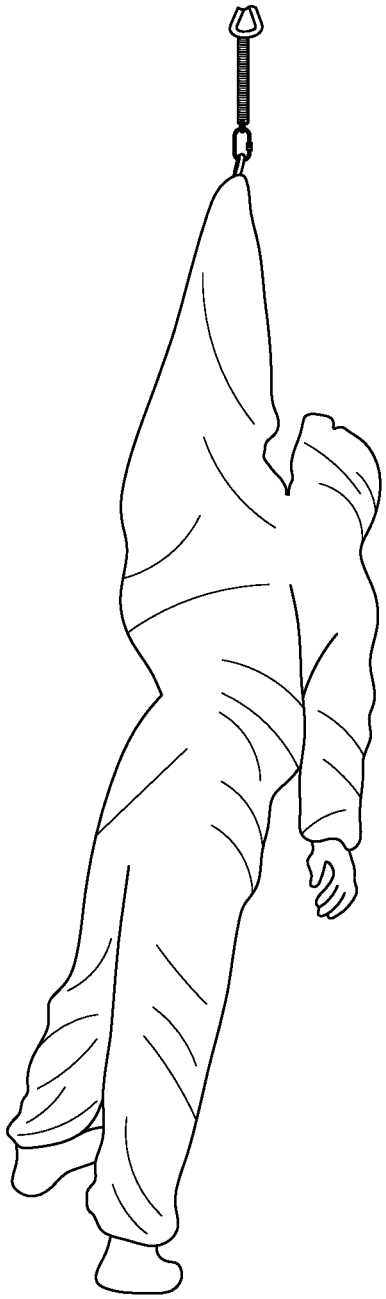
FIG. 10 illustrates manikin testing of the garment, with the garment in the form of a coverall with a hood and worn with a safety harness is shown hanging by a safety harness rope. The figure further illustrates the positive effect of the gather at the waist.

FIG. 10 illustrates manikin testing of the garment, with the garment in the form of a coverall with a hood and worn over a safety harness, the manikin shown hanging by the safety harness rope. This figure further illustrates the positive effect of the gather 32 at the waist, which can help to manage the excess fabric above the waist during the use of the garment. In some embodiments, the excess fabric is created by use of a pattern that provides a definite convex outward shape of the center back seam of the coverall. In some preferred embodiments, the length of the center back seam of the coverall, as measured from the neckline to the waistline gather, is at least 150% longer than a protective garment having a standard design back.

Figure 11:
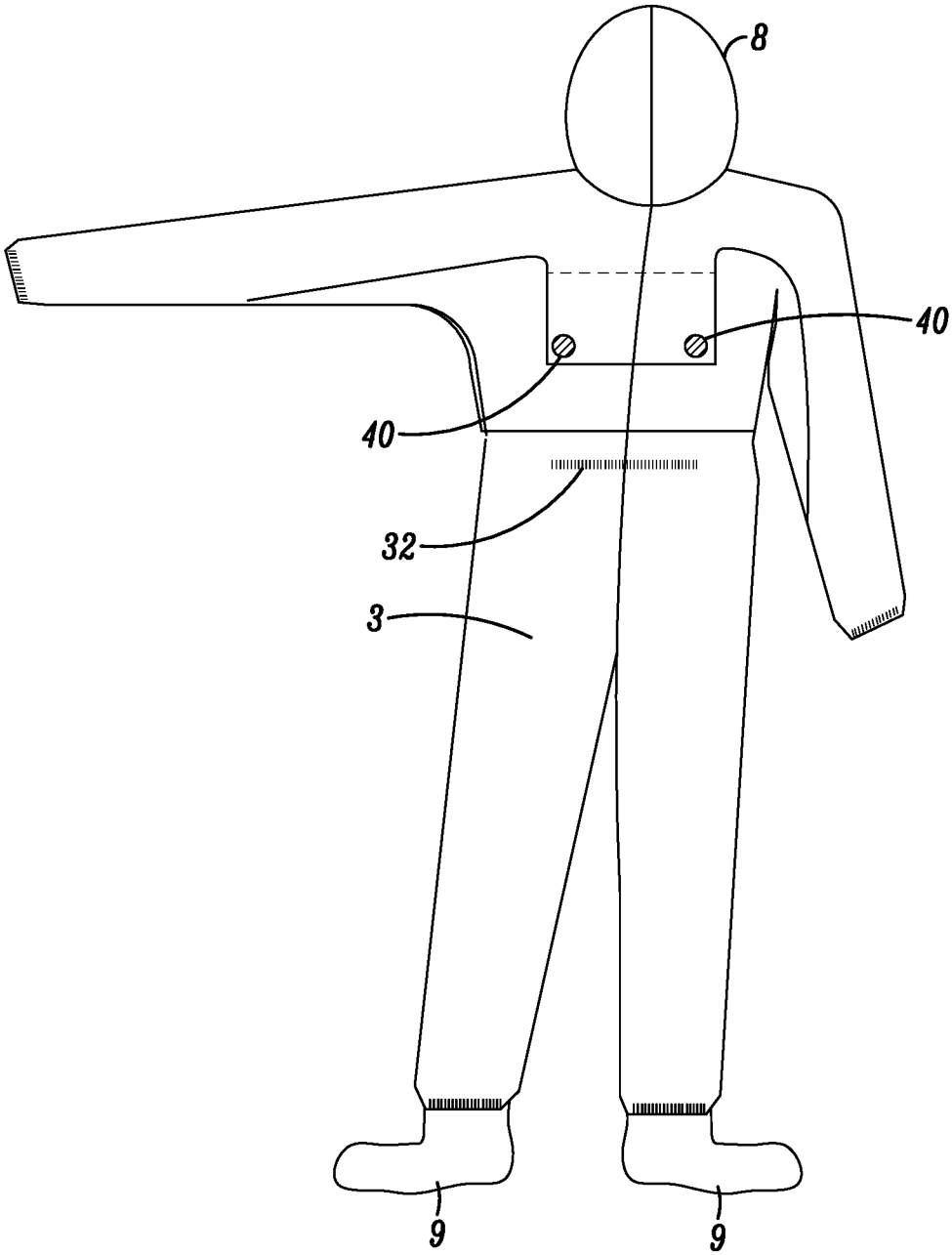
FIG. 11 illustrates the garment back wherein the garment is further provided with at least one fastener for attaching the support harness conduit to the garment when not in use.

FIG. 11 illustrates the garment back 3 wherein the garment is further provided with at last one fastener 40 for attaching the support harness conduit to the garment when not in use. Preferably the support harness conduit is rolled or folded back onto itself, above the gather 32 at the waist, and then secured with fastners. Preferably there are at least two fasteners 40 symmetrically spaced on the support harness. The fasteners keep the support harness conduit in place and give the user the flexibility to use the garment with or without a harness without having to worry about the chemical protection of the suit. Many types of fasteners may be used as long as they do not perforate the protective fabric in a way that impacts chemical performance. Various useful types of fasteners include hook and loop, adhesive hook and loop, magnetic sewn in, adhesive magnetics, snaps, ties, zipper, buttons, and mixtures thereof.

FIG. 11 also illustrates the protective garment can further comprise attached foot coverings 9. Such foot coverings can include overshoes or socks that are sewn to the ends of legs of the coveralls.

Any of the parts or features of the protective garment described herein can further comprise a lining fabric. In the garment, the lining fabric is preferably positioned between the wearer and any outer protective fabric. The lining can be any suitable fabric comfortable to the skin, but especially useful are woven or nonwoven fabrics. Preferably the lining is a spunlaced or spunbonded nonwoven fabric comprising fibers or filaments made from a synthetic polymer.

The protective garment preferably comprises a protective apparel fabric. The term "protective apparel fabric" is meant to include a wide variety of protective garment fabrics, barrier fabrics, laminates, and films. The term "protective apparel fabric" also includes nonwoven and/or woven fabrics and laminates of such materials with films or multilayer films. In some embodiments, the protective fabric comprises a chemically-resistant outer layer. In some preferred embodiments the protective apparel fabric, and therefore the apparel material, is a multilayer-film-and-nonwoven laminate. In some embodiments the apparel material is a nonwoven that resists penetration by liquids and/or particulates, such as a nonwoven like Tyvek® spunbonded polyethylene. One preferred protective apparel fabric is DuPont Tychem® C fabrics, which features a coated Tyvek® fabric. These fabrics provide barrier protection against a wide range of inorganic chemical and biological hazards, yet are lightweight and comfortable. Other useful fabrics are DuPont Tychem® F fabrics, which feature a film-laminated Tyvek® fabric. In addition, other useful protective apparel fabrics that protect against a wide variety of threats can be used, and include but are not limited to those generally disclosed in U.S. Pat. No. 5,626,947 (Hauer et al.); U.S. Pat. No. 4,855,178 (Langley); U.S. Pat. No. 4,272,851 (Goldstein); U.S. Pat. No. 4,772,510 (McClure); U.S. Pat. No. 5,035,941 (Blackburn); U.S. Pat. No. 4,214,321 (Nuwayser); U.S. Pat. No. 4,920,575 (Bartasis); U.S. Pat. No. 5,162,148 (Boye); and U.S. Pat. No. 4,833,010 (Langley).

It is believed the garment features described herein can be applied as part of a Level A, B, C or D protective garment. Level A garments are used in situations that require the highest level of skin, respiratory, and eye protection, and are generally totally encapsulating vapor protective garments. Level B garments are used in situations that require the highest level of respiratory protection but a lesser level of skin protection is needed. Level C garments are used in situations where atmospheric contaminants, liquid splashes, and other direct contact will not adversely affect or be absorbed by any exposed skin. Level D garments are used in situations where contamination is only a nuisance. There may be some instances where combinations of protective apparel rated for A, B, C, or D level may be used together. In some embodiments the garment is part of an encapsulating chemical-resistant suit, in some embodiments it is part of coveralls, or part of any type of shirt or coat or pants or combination garment.

The inventive protective garment features described herein are believed to help ensure the garment itself does not increase the risk of injuries to the wearer in the case of a fall. These features allow the safety harness equipment to move mostly unrestricted underneath the coverall. This is believed to reduce the potential for undue tension to the body from the protective garment at the moment of impact; that is, the moment the safety equipment stops the fall.

What is claimed is:

1. A protective garment suitable for use with a safety harness worn underneath the garment by a wearer having an interior surface and an exterior surface, and a front for covering a front of the body and a back for covering a back of the body, the protective garment comprising two arm sections, a neck section, a torso section, and a support harness conduit, the support harness conduit forming a sleeve in the garment for the passage of a safety rope from the safety harness worn by the wearer to the exterior of the garment, the support harness conduit comprising:

a flexible transition duct and a flexible rope cover, the flexible transition duct and the flexible rope cover forming a sleeve vertically centered on the back of the garment in the torso section, the transition duct having a torso end and a rope cover end, the flexible rope cover having a proximate end attached to the transition duct rope cover end, and a distal end;

the torso end of the transition duct being attached to both arm sections and the torso section, the torso end thereby having a width wider than the back of the garment, extending across the back of the garment from one arm section to the other;

the torso end of the transition duct providing an opening in the torso section between the arm sections and below the neck section, with the rope cover end of the transition duct providing an opening in the transition duct for the proximate end of the rope cover;

the distal closure end of the rope cover having a closure device to compress the conduit around the safety rope and close the conduit and reduce the interchange of fluids or particulates between the interior and the exterior of the garment;

wherein the rope cover end of the transition duct has a width that is at least 30 percent the width of the back of the garment.

2. The protective garment of claim 1, wherein that rope cover is at least 20 centimeters in length.

3. The protective garment of claim 2, wherein that rope cover is at least 1 meter in length.

4. The protective garment of claim 1, wherein the transition duct has a trapezoidal shape with the torso end being wider than the rope cover end.

5. The protective garment of claim 4, wherein the trapezoidal shape has curved sides.

6. The protective garment of claim 1, wherein the back of the garment further comprises a gather at the waist.

7. The protective garment of claim 6, wherein the gather is a band of elastic.

8. The protective garment of claim 1, wherein the garment is further provided with a fastener for attaching the support harness conduit to the garment when not in use.

9. The protective garment of claim 1, wherein the garment is a coverall having an attached hood.

10. The protective garment of claim 9 further comprising attached foot coverings.

11. The protective garment of claim 1 wherein the rope cover closure device is a nonwoven fabric tie.

12. A protective garment suitable for use with a safety harness worn underneath the garment by a wearer having an interior surface and an exterior surface, and a front for covering a front of the body and a back for covering a back of the body, the protective garment comprising two arm sections, a neck section, a torso section, and a support harness conduit, the support harness conduit forming a sleeve in the garment for the passage of a safety rope from the safety harness worn by the wearer to the exterior of the garment, the support harness conduit comprising:

a flexible transition duct and a flexible rope cover, the flexible transition duct and the flexible rope cover forming a sleeve vertically centered on the back of the garment in the torso section, the transition duct having a torso end and a rope cover end, the flexible rope cover having a proximate end attached to the transition duct rope cover end, and a distal end;

the torso end of the transition duct being attached to the back below the neck section extending vertically to above the waist of the garment, the torso end having a vertical length wider than the back of the garment;

the torso end of the transition duct providing an opening in the torso section between the arm sections and below the neck section, with the rope cover end of the transition duct providing an opening in the transition duct for the proximate end of the rope cover;

the distal closure end of the rope cover having a closure device to compress the conduit around the safety rope and close the conduit and reduce the interchange of fluids or particulates between the interior and the exterior of the garment;

wherein the rope cover end of the transition duct has a width that is at least 30 percent the width of the back of the garment.

13. The protective garment of claim 12, wherein that rope cover is at least 20 centimeters in length.

14. The protective garment of claim 13, wherein that rope cover is at least 1 meter in length.

15. The protective garment of claim 12, wherein the transition duct has a trapezoidal shape with the torso end being wider than the rope cover end.

16. The protective garment of claim 15, wherein the trapezoidal shape has curved sides.

17. The protective garment of claim 12, wherein the back of the garment further comprises a gather at the waist.

18. The protective garment of claim 17, wherein the gather is a band of elastic.

19. The protective garment of claim 12, wherein the garment is further provided with a fastener for attaching the support harness conduit to the garment when not in use.

20. The protective garment of claim 12, wherein the garment is a coverall having an attached hood.

21. The protective garment of claim 20 further comprising attached foot coverings.

22. The protective garment of claim 12 wherein the rope cover closure device is a nonwoven fabric tie.

* * * * *